US010281878B2

(12) United States Patent
Breuilh et al.

(10) Patent No.: US 10,281,878 B2
(45) Date of Patent: May 7, 2019

(54) WATCH MECHANISM

(71) Applicant: ROLEX SA, Geneva (CH)

(72) Inventors: Martin Breuilh, Annemasse (FR); Denis Rudaz, Segny (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/793,409

(22) Filed: Oct. 25, 2017

(65) Prior Publication Data

US 2018/0120770 A1 May 3, 2018

(30) Foreign Application Priority Data

Oct. 28, 2016 (EP) ..... 16196170

(51) Int. Cl.
*G04B 19/04* (2006.01)
*G04B 11/02* (2006.01)
*G04B 13/02* (2006.01)
(Continued)

(52) U.S. Cl.
CPC ..... *G04B 19/042* (2013.01); *G04B 11/02* (2013.01); *G04B 13/02* (2013.01); *G04B 19/25* (2013.01);
(Continued)

(58) Field of Classification Search
CPC ..... G04B 19/042; G04B 11/02; G04B 13/02; G04B 19/25; G04B 19/268; G04B 35/00;
(Continued)

(56) References Cited

U.S. PATENT DOCUMENTS 3,645,090 A * 2/1972 Mochizuki ..... G04B 11/006 368/32
4,432,081 A * 2/1984 Schwartz ..... G04B 19/25 368/221
(Continued)

FOREIGN PATENT DOCUMENTS

EP 1 286 233 A1 2/2003
EP 2 615 506 A1 7/2013
(Continued)

OTHER PUBLICATIONS

European Search Report and Written Opinion dated May 4, 2017 issued in counterpart application No. EP16196170; w/ English partial translation and partial machine translation (11 pages).

*Primary Examiner* — Edwin A. Leon
(74) *Attorney, Agent, or Firm* — Westerman, Hattori, Daniels & Adrian, LLP

(57) ABSTRACT

Watch mechanism (100) including an element for the display of time, first and second elements (Q, PDL) for the display of first and second pieces of watch information derived from time, the mechanism including: —a first kinematic chain (CC1) for the simultaneous correction of time display, and the display of the first and second pieces of watch information; —a second kinematic chain (CC2) for the correction of the time display independently of the display of the second piece of watch information, and —a third kinematic chain (CC3) for the correction of the display of the second piece of watch information independently of the time display and the display of the first piece of watch information. The third chain includes an epicyclic gear train (TE) connected kinematically to the element (H) for the time display by a notched wheel (MC) included in the first and second kinematic chains.

20 Claims, 6 Drawing Sheets

(51) Int. Cl.

| | |
|---|---|
| ***G04B 35/00*** | (2006.01) |
| ***G04B 19/25*** | (2006.01) |
| ***G04B 19/26*** | (2006.01) |
| *G04B 15/12* | (2006.01) |

(52) U.S. Cl.
CPC ..... *G04B 19/268* (2013.01); *G04B 35/00* (2013.01); *G04B 15/12* (2013.01)

(58) Field of Classification Search
CPC ..... G04B 15/12; G04B 19/253; G04B 19/22; G04B 13/021; G04B 19/26; G04B 27/00
USPC ..... 368/238
See application file for complete search history.

(56) References Cited

U.S. PATENT DOCUMENTS

| | | | | |
|---|---|---|---|---|
| 4,443,112 | A | 4/1984 | Stotz et al. | |
| 8,837,260 | B2 | 9/2014 | Zaugg | |
| 9,348,312 | B2 * | 5/2016 | Gruenig | G04B 15/08 |
| 9,383,724 | B2 | 7/2016 | Rebetez | |
| 9,594,348 | B2 * | 3/2017 | Denden | G04B 13/008 |
| 2010/0027381 | A1 * | 2/2010 | Mahler | G04B 19/02 368/28 |
| 2012/0243381 | A1 * | 9/2012 | Goeller | G04B 19/25 368/34 |
| 2013/0176827 | A1 | 7/2013 | Zaugg | |
| 2013/0201801 | A1 * | 8/2013 | Calabrese | G04B 19/25 368/34 |
| 2013/0250737 | A1 | 9/2013 | Villar | |
| 2015/0346689 | A1 | 12/2015 | Rebetez | |

FOREIGN PATENT DOCUMENTS

| | | |
|---|---|---|
| EP | 2 642 354 A1 | 9/2013 |
| EP | 2 950 164 A1 | 12/2015 |
| FR | 2 541 005 A1 | 8/1984 |

* cited by examiner

WATCH MECHANISM

This application claims priority of European patent application No. EP16196170.1 filed Oct. 28, 2016, which is hereby incorporated by reference herein in its entirety.

The invention relates to a watch mechanism having a plurality of displays of watch information or information derived from time. The invention further relates to a watch movement comprising a suchlike watch mechanism. The invention finally relates to a timepiece comprising a suchlike watch mechanism or a suchlike watch movement.

BACKGROUND ART

Patent Application FR2541005 discloses a mechanism for the display and adjustment of the date implemented by means of an epicyclic gear train, of which the output takes the form of a crown equipped with a calendar driving finger which is capable of being in engagement with a calendar driving disk. During the conventional operation of the timepiece, the planetary gear carrier is engaged by the kinematic chain for driving the calendar, which is in engagement with the hour wheel. In this configuration, the sun gear is fixed by means of a correction wheel which is indexed by a spring. The planetary gear thus moves relative to the pinion and drives the crown rotatably by means of the internal toothing of the latter. The planetary gear carrier is in direct engagement with the hour wheel, so that a rotation of the hour hand necessarily entails a rotation of the crown. It is thus not possible to set the time without acting on the adjustment device of which the epicyclic gear train forms part. Furthermore, a suchlike construction of an epicyclic gear train is not optimal to the extent that it requires a particularly complicated crown, which combines internal and external toothing. The tolerances of the guide portions must thus be minimized to the greatest possible extent so as to reduce the radial and longitudinal movements, and thus to minimize the risks of butting between the different toothings. The crown must likewise be sufficiently thick to combine an internal toothing and a guide portion sufficient to permit appropriate pivoting.

Patent Application EP2615506, for its part, discloses a specific design of an epicyclic gear train which is provided in order to permit the adjustment of a device for the display of the phases of the moon. The first input of the planetary gear set is constituted by a crown, of which the external toothing is in engagement with the going train of the basic movement, in particular by means of the hour wheel, and of which the internal toothing is in engagement with at least one planetary gear mounted in a pivotable manner on a planetary gear carrier in engagement with the wheel for the display of the phases of the moon. The second input of the planetary gear set is constituted by a correction star of the phases of the moon, of which the angular position is provided in order to be locked by a jumper, and of which the actuation is controlled by a correction rocker bar. This star is likewise in engagement with the planetary gear by means of a wheel which is integral therewith. During the conventional operation of the timepiece, the display wheel is actuated by the hour wheel by the intervention of the planetary gear carrier and its planetary gear, which pivots relative to the correction wheel. During the correction phase, the display wheel is actuated by the wheel by the intervention of the planetary gear carrier and its planetary gear, which pivots relative to the crown. The first input of the planetary gear set is in direct engagement with the hour wheel, so that a rotation of the element for the display of time necessarily entails a rotation of the display wheel. It is thus not possible to set the time independently of the adjustment device in which the epicyclic gear train plays a part. Furthermore, a suchlike construction of the epicyclic gear train in not optimal to the extent that it requires a crown equipped with a first internal toothing and with a second external toothing disposed on a single level, which cannot be pivoted satisfactorily on the same axis as that of the planetary gear carrier and the correction star. The tolerances of the guide portions require to be minimized to the greatest possible extent, furthermore, in order to reduce the radial and longitudinal movements, and thus to minimize the risks of butting between the different toothings, in particular those of the planetary gear which is in engagement with internal and external toothings.

Patent Application EP2950164 likewise discloses a device for the display and correction of the phases of the moon. This device implements a specific design of a differential train. The first input is constituted by a wheel in engagement with a 24-hour wheel of a calendar system, on which a spring is mounted. This spring is intended to interact with a correction star that is integral with a wheel of a kinematic correction chain which constitutes the second input of the planetary gear set. The correction star is likewise integral with a pinion that is continuously in engagement with the planetary gears of a planetary gear carrier which constitutes the output of the planetary gear set associated with the element for the display of the moon phase indication. During the conventional operation of the timepiece, the wheel drives the pinion by means of the spring which is in elastic engagement with the correction star. The pinion thus meshes with the planetary gears, which are likewise in engagement with an internal toothing that is integral with the frame of the movement. The meshing of the planetary gears thus induces the rotation of the planetary gear carrier. During the adjustment phase, the actuation of the correction wheel induces the rotation of the star relative to the spring, which is then indexed angularly by the wheel.

A suchlike design is not optimal to the extent that it requires a coupling device between the adjustment mechanism control and the correction wheel, given that the latter rotates continuously. Furthermore, the driving wheel is in direct engagement with the 24-hour wheel of the calendar system, so that it is not possible to correct the calendar independently of the indication of the phases of the moon. Lastly, in order for it to function, the differential train requires a corresponding internal toothing fixed to the frame, which must be in engagement with each of the planetary gears, which is not optimal in terms of the assembly of the device within the timepiece. What is more, the tolerances of the guide portions must be minimized to the greatest possible extent in this case, too, in order to reduce the radial and longitudinal movements, and thus to minimize the risks of butting between the different toothings.

Documents FR2541005, EP2615506 and EP2950164 disclose watch designs in which, in addition to their complexity, a correction of one watch indication is not able to be performed independently of a correction of another watch indication.

SUMMARY OF THE INVENTION

The aim of the invention is to make available a watch mechanism permitting the disadvantages mentioned previously to be addressed and the watch mechanisms that are known from the prior art to be improved. In particular, the invention proposes a watch mechanism permitting the independent adjustment of the different watch information.

A watch mechanism according to the invention is defined by the following point 1.

1. A watch mechanism comprising an element for the display of time, a first element for the display of a first piece of watch information derived from time and a second element for the display of a second piece of watch information derived from time, the mechanism comprising:
   - a first kinematic chain for the simultaneous correction of the display of time, the display of the first piece of watch information and the display of the second piece of watch information,
   - a second kinematic chain for the correction of the display of time independently of the display of the second piece of watch information, and
   - a third kinematic chain for the correction of the display of the second piece of watch information independently of the display of time and the display of the first piece of watch information, the third kinematic correction chain comprising an epicyclic gear train, the epicyclic gear train being connected kinematically to the element for the display of time by a notched wheel, and the first and second kinematic chains comprising the notched wheel.

Different embodiments of the watch mechanism according to the invention are defined by the following points 2 to 12.

2. The watch mechanism as defined in point 1, wherein the notched wheel constitutes a motion-work wheel.
3. The watch mechanism as defined in point 1 or 2, wherein the notched wheel comprises a first wheel engaged with an hour wheel and a second wheel engaged with a cannon-pinion, the first and second wheels being connected by an indexing element of the first wheel relative to the second wheel.
4. The watch mechanism as defined in the preceding point, wherein the indexing element comprises a spring mounted on the second wheel and a cam mounted, notably fixed, on the first wheel, the spring and the cam being so arranged as to interact through contact one with the other.
5. The watch mechanism as defined in one of the preceding points, wherein the epicyclic gear train comprises a planetary gear carrier in permanent kinematic connection with the notched wheel, a first planetary pinion in permanent kinematic connection with an element for the correction of the second piece of watch information, a second planetary pinion in permanent kinematic connection with a wheel of the second element for the display of the second piece of watch information and at least one planetary gear pivoted on the planetary gear carrier.
6. The watch mechanism as defined in the preceding point, wherein the first and second planetary pinions are in meshing engagement with the at least one planetary gear via external teeth of the first and second planetary pinions.
7. The watch mechanism as defined in one of points 5 and 6, wherein the planetary gear carrier comprises external toothing.
8. The watch mechanism as defined in one of points 5 to 7, wherein a pitch circle radius of the second planetary pinion is smaller than the axial distance of the gearing constituted by the first planetary pinion and the at least one planetary gear, or the pitch circle radius of the second planetary pinion is substantially equal to the pitch circle radius of the first planetary pinion, or the pitch circle radius of the second planetary pinion is smaller than the pitch circle radius of the first planetary pinion.
9. The watch mechanism as defined in one of points 5 to 8, wherein the correction element is a correction wheel comprising a correction star so arranged as to be actuated by a means of control, more particularly via a lever.
10. The watch mechanism as defined in one of the preceding points, wherein the first and second kinematic correction chains are so arranged as to be capable of being engaged with a stem.
11. The watch mechanism as defined in one of the preceding points, wherein the first piece of watch information derived from time is a piece of calendar information, notably a piece of date information.
12. The watch mechanism as defined in one of the preceding points, wherein the second piece of watch information derived from time is a piece of moon phase information.

A watch movement according to the invention is defined by point 13.

13. A watch movement comprising a mechanism as defined in one of the preceding points.

A timepiece according to the invention is defined by point 14.

14. A timepiece comprising a watch movement as defined in the preceding point or a mechanism as defined in one of points 1 to 12.

BRIEF DESCRIPTION OF THE DRAWINGS

The accompanying figures illustrate, by way of example, an embodiment of a timepiece incorporating an embodiment of a watch mechanism according to the invention.

DETAILED DESCRIPTION OF PARTICULAR EMBODIMENTS

Figure 1:
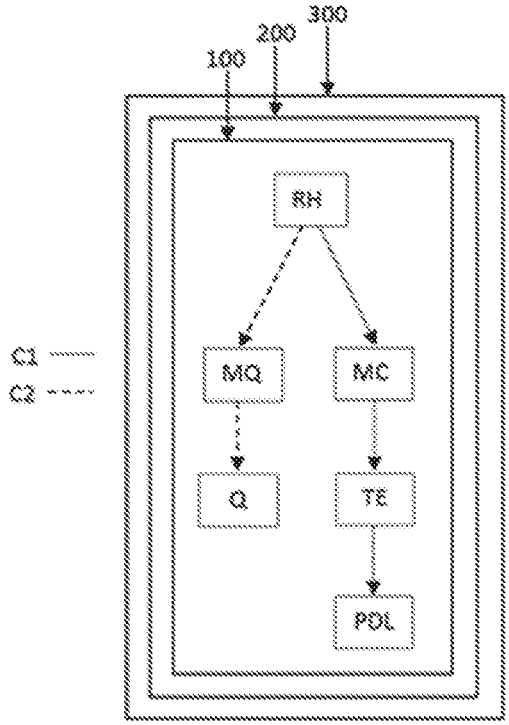
FIG. 1 is a schematic view of an embodiment of a timepiece according to the invention.
Figure 2:
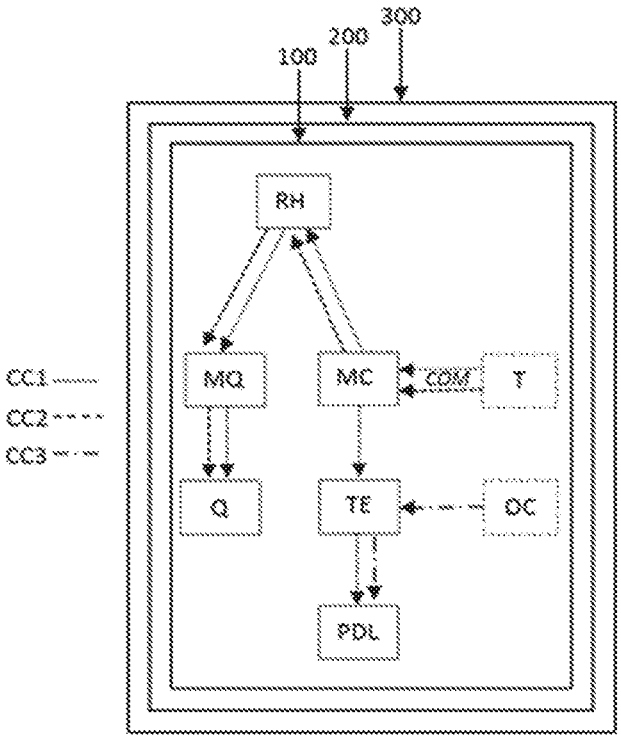
FIG. 2 is another schematic view of the embodiment of the timepiece according to the invention.

An embodiment of a timepiece 300 according to the invention is described below with reference to FIGS. 1 to 9.

The timepiece is a watch, for example, in particular a wristwatch. The timepiece comprises an embodiment of a watch movement 200 according to the invention, in particular a mechanical movement. The movement is such as to exhibit, for example, a calendar system intended to display the phases of the moon. More particularly, the described embodiment of a movement comprises a device for the display and correction of the phases of the moon, which is associated with a device for the rapid correction of time provided more particularly in order to permit the rapid adjustment of the date or also the adjustment of a time zone.

The watch movement 200 comprises an embodiment of a mechanism 100 according to the invention.

The watch mechanism 100 comprises an element H for the display of time, a first element Q for the display of a first piece of watch information derived from time and a second element PDL for the display of a second piece of watch information derived from time. The mechanism comprises:

- a first kinematic chain CC1 for the simultaneous correction of the display of time, the display of the first piece of watch information and the display of the second piece of watch information,
- a second kinematic chain CC2 for the correction of the display of time independently of the display of the second piece of watch information, and
- a third kinematic chain CC3 for the correction of the display of the second piece of watch information independently of the display of time and the display of the first piece of watch information, the third kinematic correction chain CC3 comprising an epicyclic gear train TE, the first and second kinematic correction chains comprising a notched wheel MC.

Preferably, the epicyclic gear train is connected kinematically to the element H for the display of time by the notched wheel. More preferably, the notched wheel is a wheel common to the first and second kinematic correction chains.

In the depicted embodiment, the first piece of watch information derived from time is calendar information, more particularly date information. The first element for the display of a first piece of watch information derived from time thus comprises, for example, a disk or a ring Q bearing calendar information and interacting with an aperture provided on a dial in such a way as to display the current date information.

In the depicted embodiment, the second piece of watch information derived from time is a piece of moon phase information. The second element for the display of a second piece of watch information derived from time thus comprises, for example, a disk PDL bearing two representations of the moon positioned at 180° one from the other relative to the center of the disk and interacting with an aperture provided on the dial in order to display the current moon phase information.

The mechanism implements a drive wheel TE for the second element PDL for the display of the second piece of watch information derived from time, which exhibits the specific characteristic of acting as a wheel for the rapid correction of the second element PDL for the display of the second piece of watch information derived from time during adjustment of the timepiece. In order to do this, the drive wheel is an epicyclic gear train TE of which the construction is particularly simple, compact and robust. This epicyclic gear train exhibits, furthermore, the particular feature of being in engagement with the time display element, in this case being a principal hand of the timepiece, for example an hour hand, and a minute hand, by means of a corresponding coupling mechanism constituted by the notched wheel. This coupling mechanism is intended to permit the adjustment of the first element Q for the display of the first piece of watch information derived from time independently of the adjustment of the second element PDL for the display of the second piece of watch information derived from time.

Figure 5:
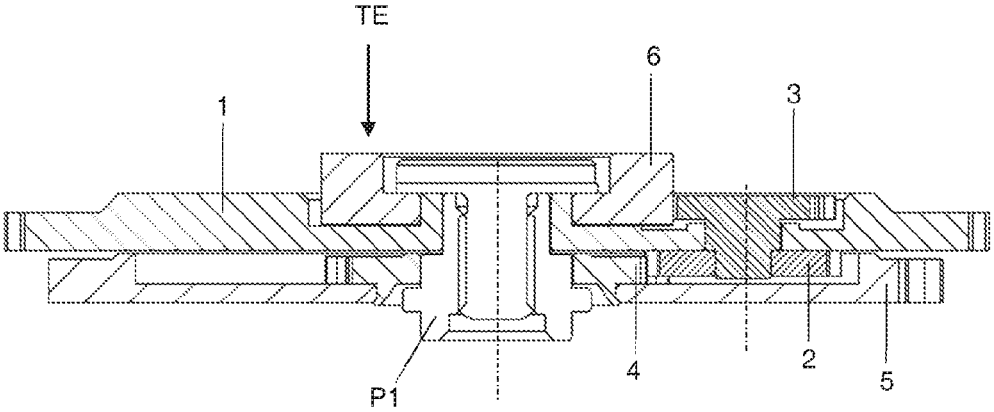
FIG. 5 is a sectioned view of an epicyclic gear train utilized in the embodiment of the timepiece according to the invention.
Figure 6:
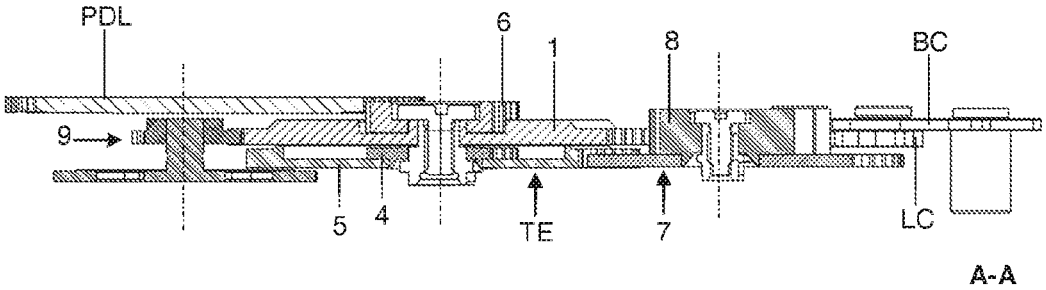
FIG. 6 is a partially sectioned view in the planes A-A in FIG. 3 of an embodiment of a mechanism according to the invention.

The epicyclic gear train TE comprises, as depicted in FIG. 5, a planetary gear carrier 1 in permanent kinematic connection with the notched wheel MC, a first planetary pinion 4 in permanent kinematic connection with an element 7 for the correction of the second element PDL for the display of the second piece of watch information derived from time, a second planetary pinion 6 in permanent kinematic connection with a wheel of the element PDL for the display of the second piece of watch information derived from time, and at least one planetary gear 2, 3 pivoted on the planetary gear carrier. Preferably, the epicyclic gear train TE has a particularly simple structure. In the described embodiment, the going trains of the epicyclic gear train TE are not equipped only with external toothings, for example. The going trains of the epicyclic gear train TE are configured in order to be caused to pivot only by a single means of pivoting, which may take the form, for example, of a screw foot P1 integral with a frame of the movement. This configuration permits a particularly simple and compact implementation of an epicyclic gear train which involves only gearings with external toothing. Preferably, the pitch circle radius of the second planetary pinion 6 is smaller than the axial distance of the gearing of the first planetary pinion 4 with the planetary gear 2, or is substantially identical to the pitch circle radius of the first planetary pinion 4, or is smaller than the pitch circle radius of the first planetary pinion 4. This ensures a particularly robust design.

Advantageously, the first and second planetary pinions 4, 6 are thus in meshing engagement with the at least one planetary gear via external teeth of the first and second planetary pinions.

Figure 3:
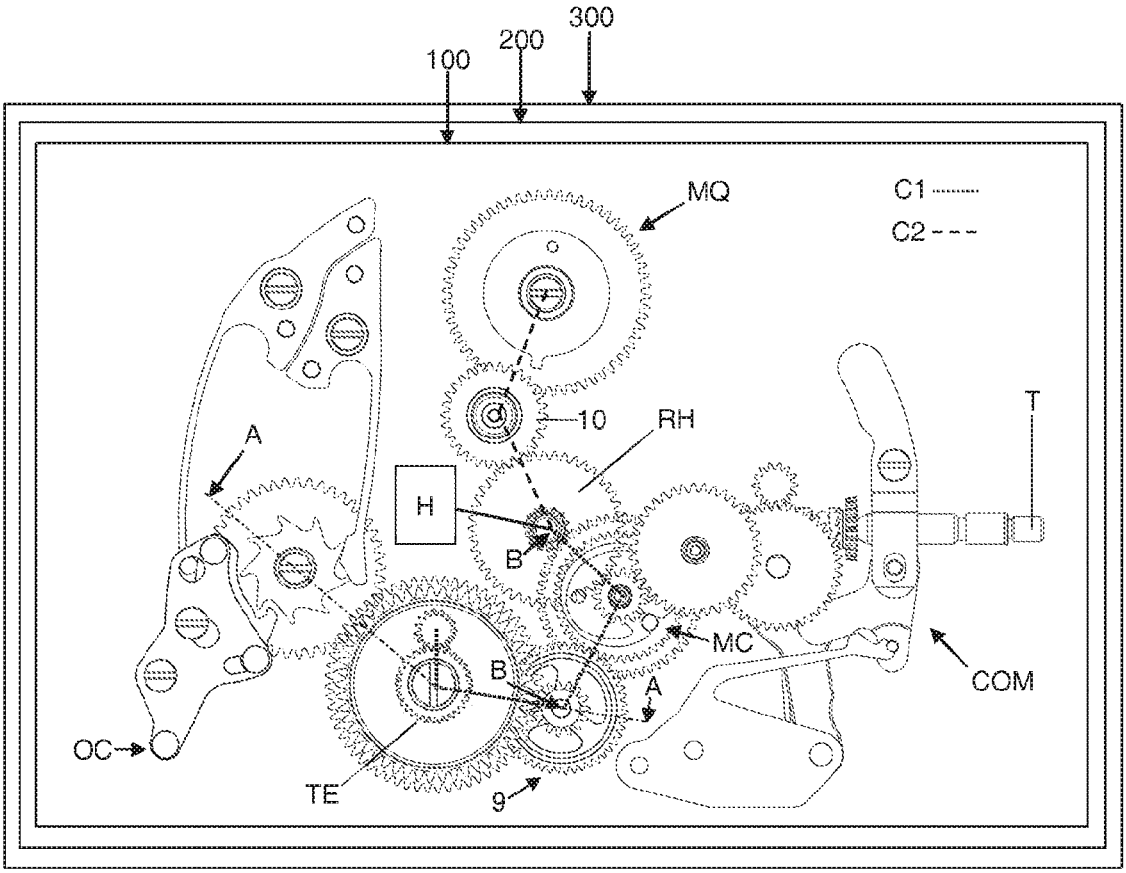
FIG. 3 is a view of the embodiment of the timepiece according to the invention, said view highlighting the kinematic chains for driving two elements for the display of watch information.
Figure 4:
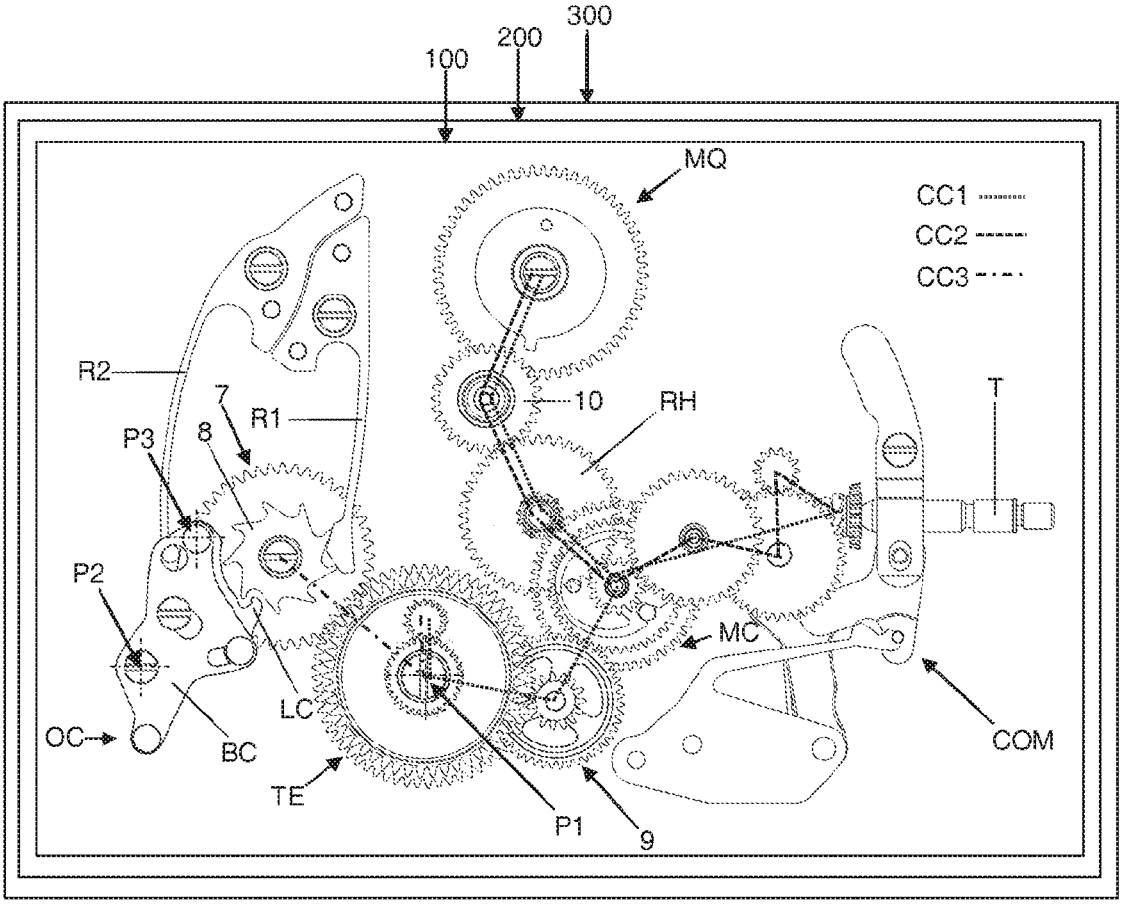
FIG. 4 is a view of the embodiment of the timepiece according to the invention, said view highlighting the kinematic chains for the correction of three elements for the display of watch information.

As depicted in FIGS. 3 and 4, the watch mechanism comprises a first kinematic chain C1 for driving the second element PDL for the display of the second piece of watch information derived from time. The first kinematic chain C1 is driven rotatably by an hour wheel RH, which is connected to the basic movement by means of a cannon-pinion CH. The hour wheel RH drives the epicyclic gear train TE rotatably by means of the coupling mechanism, which adopts the form of the notched wheel MC and of a wheel 9. An output from the epicyclic gear train TE is in engagement with the second element for the display of the second piece of watch information derived from time, being in this case the second element for the display of the phases of the moon PDL (not depicted in FIGS. 3 and 4).

The watch mechanism also comprises a second kinematic chain C2 for driving the first element Q for the display of the first watch information derived from time. The second kinematic chain C2 is likewise driven rotatably by the hour wheel RH, which is connected to the basic movement by means of the cannon-pinion CH. The hour wheel RH drives a date driving wheel MQ causing it to rotate. The date driving wheel MQ is provided for the purpose of actuating the first element for the display of the first piece of watch information derived from time, being in this case the first element for the display of the date Q (depicted in FIGS. 1 and 2, but not depicted in FIGS. 3 and 4).

The watch mechanism likewise comprises a third kinematic chain for driving the element H for the display of time. The third kinematic chain is driven rotatably by the cannon-pinion CH, which is connected kinematically to the basic movement. In the embodiment described here, the cannon-pinion CH drives the notched wheel MC rotatably, which in turn drives the hour wheel RH. In this way, the notched wheel MC constitutes a motion-work wheel connecting the cannon-pinion CH, on which is mounted or fixed an element for the display of the minutes, more particularly the minute hand, and the hour wheel RH, on which is mounted or fixed the element H for the display of time (depicted schematically in FIG. 3), more particularly the hour hand. In this embodiment, the element for the display of the minutes is thus kinematically linked to rotate with the cannon-pinion CH, and the hour display element is thus kinematically linked to rotate with the wheel RH.

Figure 9:
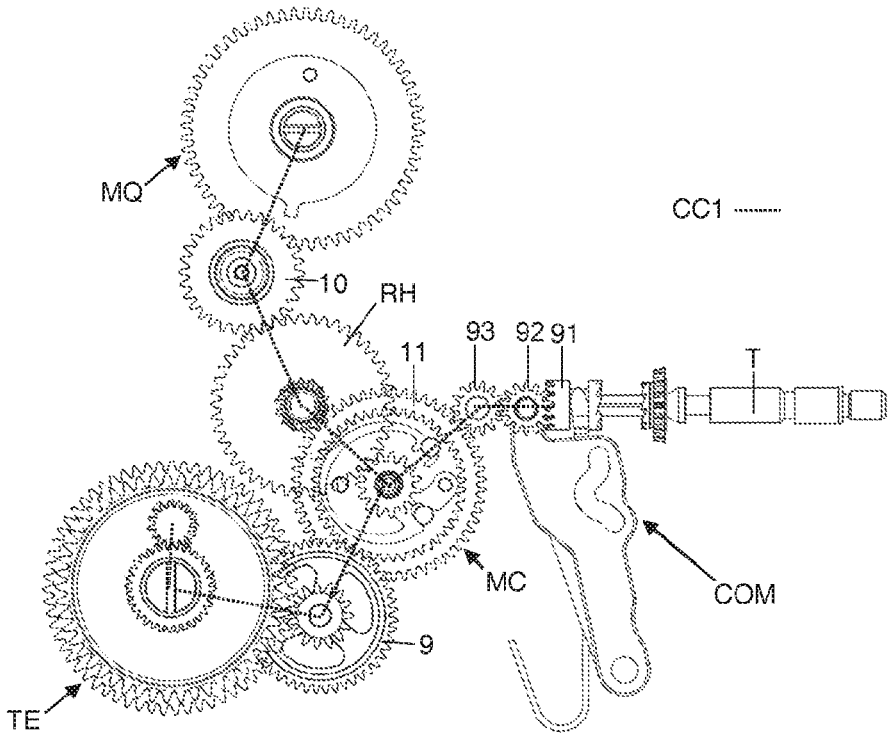
FIG. 9 is a view of the embodiment of the timepiece according to the invention, said view highlighting a first kinematic chain for the simultaneous correction of three elements for the display of watch information.

The first kinematic correction chain CC1 permits the adjustments of the hour and of the minutes, of the date, and of the phase of the moon simultaneously. As depicted in FIG. 9, the first kinematic correction chain CC1 comprises a stem T equipped with a pinion 91 with face toothing, a first intermediate wheel 92, a second intermediate wheel 93, the notched wheel MC, the hour wheel RH, a wheel 10, the date driving wheel MQ, the wheel 9 and the epicyclic gear train TE.

Figure 10:
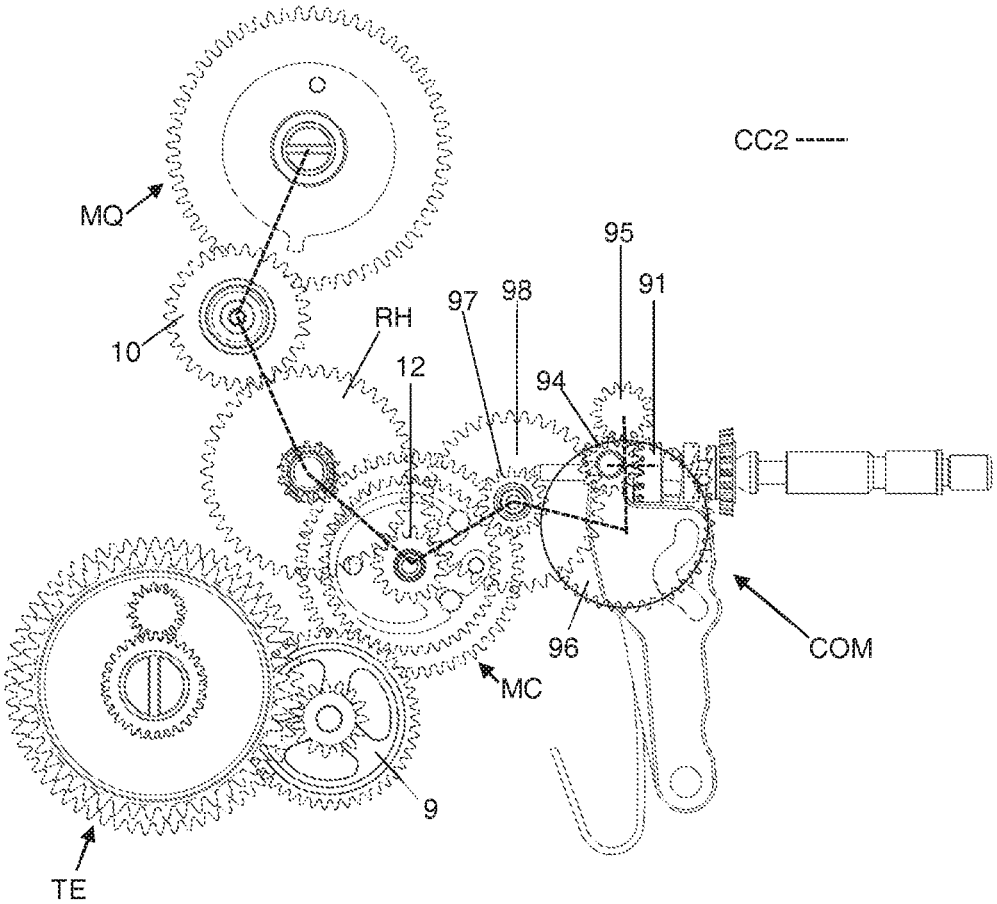
FIG. 10 is a view of the embodiment of the timepiece according to the invention, said view highlighting a second kinematic chain for the simultaneous correction of two elements for the display of watch information.

The second kinematic chain CC2 for the rapid correction of time permits a rapid adjustment of the hour independently of the display of the minutes. A suchlike kinematic correction chain permits more particularly a rapid correction of the first element Q for the display of the first piece of watch information derived from time without affecting the second element PDL for the display of the second piece of watch information derived from time. As depicted in FIG. 10, the second kinematic correction chain CC2 comprises the stem T equipped with the pinion 91 with face toothing, a third intermediate wheel 94, a fourth intermediate wheel 95, a fifth intermediate wheel 96, a sixth intermediate wheel 97, a seventh intermediate wheel 98, a pinion 12 of the notched wheel MC, the hour wheel RH, the wheel 10 and the date driving wheel MQ.

The kinematic correction chains CC1 and CC2 may be activated by means of a switching mechanism COM. The first and second kinematic correction chains are thus so arranged as to be capable of being engaged with the stem T by means of the switching mechanism COM. In the embodiment depicted, the switching mechanism COM is controlled by the stem T, more particularly by the axial position of the stem. The switching mechanism COM may comprise a setting lever. The switching mechanism COM may likewise comprise all the traditional elements which constitute this type of switching mechanism on the stem.

Lastly, the third kinematic correction chain CC3 is partially integrated within the epicyclic gear train TE. The third kinematic correction chain CC3 permits an independent correction of the element for the display of the phases of the moon by the actuation of a means of control OC. The third kinematic correction chain CC3 comprises the means of control OC, a correction rocker bar BC, a lever LC, a correction wheel 7 and the epicyclic gear train TE. The means of control is preferably made in a single piece. In the embodiment depicted, the means of control is a push-button.

The notched wheel MC permits the decoupling of the kinematic correction chains CC1 and CC2, so that rotation of the hour wheel RH independently of the rotation of the element for the display of the phases of the moon PDL is made possible.

A first input of the epicyclic gear train is constituted by the planetary gear carrier 1. The planetary gear carrier 1 is in engagement with the hour wheel RH by means of the notched wheel MC and a wheel 9. A planetary gear in the form of a wheel comprising a first intermediate wheel 2 and a second intermediate wheel 3 is pivoted on the planetary gear carrier 1. The two intermediate wheels 2, 3 are integral and are disposed to either side of the disk of the planetary gear carrier 1. The first intermediate wheel 2 is in engagement with a second input of the epicyclic gear train. This second input of the epicyclic gear train is constituted by the pinion 4. The second intermediate wheel 3 is in engagement with the output pinion 6 of the epicyclic gear train. This output pinion 6 is in kinematic connection with the second element PDL for the display of the second piece of watch information derived from time.

During the conventional operation of the watch mechanism, the planetary gear carrier 1 is driven rotatably under the influence of the hour wheel RH by means of the notched wheel MC and of the wheel 9. The intermediate wheels 2, 3 are thus driven rotatably relative to the first planetary pinion 4, which is maintained in position under the effect of indexing means R1, 8 being part of the third kinematic correction chain CC3. The output from the epicyclic gear train constituted by the second planetary pinion 6 is thus driven rotatably by the second intermediate wheel 3. It follows that the second element PDL for the display of the second piece of watch information derived from time is driven by the pinion 6. The driving speed of the second element PDL for the display of the second piece of watch information derived from time is defined by the demultiplication given by the number of the toothed wheels being part of the first kinematic chain C1.

During the actuation of the third kinematic correction chain CC3 under the effect of the means of control OC, the first planetary pinion 4 is driven rotatably under the effect of the rotation of a wheel 5 which is integral with the first planetary pinion 4, in particular which is fixed on the first planetary pinion 4. In this configuration, the planetary gear carrier 1 is immobilized by the first kinematic chain C1, and more specifically by the cannon-pinion CH which is frictionally mounted on a going train of the basic movement. The rotation of the first planetary pinion 4 thus drives the rotation of the intermediate wheel 3 by means of the intermediate wheel 2, and thus the rotation of the second planetary pinion 6 and the movement of the second element PDL for the display of the second piece of watch information derived from time.

The third kinematic correction chain CC3 comprises more specifically the correction wheel 7 including a correction star 8. The correction star 8 is maintained in position by a spring-strip R1, as depicted in FIG. 4. The correction star 8 is so arranged as to be actuated by the means of control OC, more particularly by a rocker bar BC. During the conventional operation of the timepiece, the first planetary pinion 4 is maintained in position by the spring-strip R1 via the elements 7, 8, 5. The third kinematic correction chain CC3 is actuated rotatably under the effect of the means of control OC by means of the correction rocker bar BC, pivoted about an axis P2, and exhibiting the correction lever LC, which is pivoted about an axis P3 on the rocker bar. The rocker bar and the lever are both biased in position by a single spring strip R2 in such a way that the rocker bar/lever assembly acts in a unidirectional manner on the correction star 8 according to a predetermined angular pitch.

Figure 7:
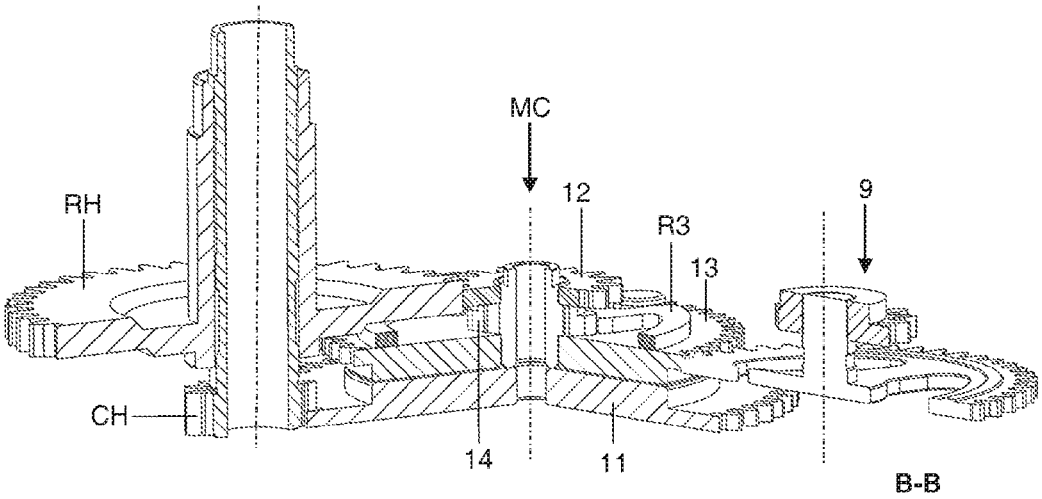
FIG. 7 is a sectioned view in the planes B-B in FIG. 3 of a notched wheel utilized in the embodiment of the timepiece according to the invention.
Figure 8:
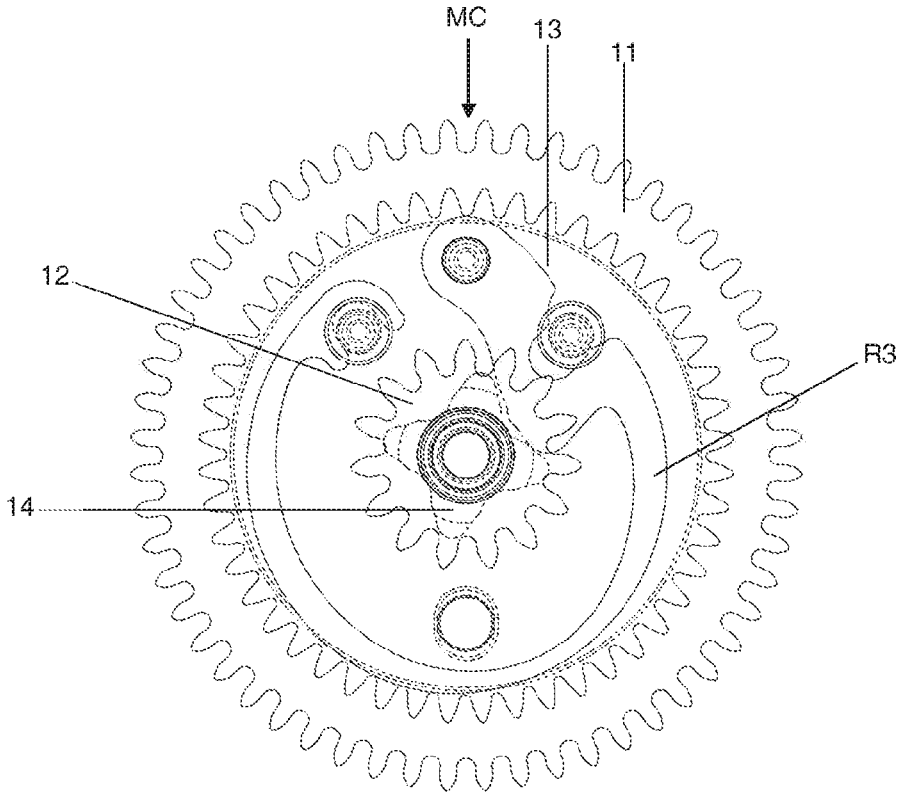
FIG. 8 is a detailed view of an example of a notched wheel utilized in the embodiment of the timepiece according to the invention.

The notched wheel MC is disposed at the interface of the wheel 9, the cannon-pinion CH and the hour wheel RH, as depicted in FIGS. 7 and 8. The notched wheel MC thus constitutes a motion-work wheel linking together the hour wheel RH and the cannon-pinion CH. More advantageously, the notched wheel MC connects the epicyclic gear train TE by means of the planetary gear carrier 1. FIG. 7 represents a partially sectioned view in the planes B-B depicted in FIG. 3. The notched wheel MC comprises the first wheel 12 engaged with the hour wheel RH and a second wheel 11, 13 engaged with the cannon-pinion CH, the first and second wheels being connected by an indexing element R3, 14 of the first wheel 12 relative to the second wheel 11, 13. The second wheel 11, 13 comprises a wheel 11. The second wheel constitutes a first input of the notched wheel. The wheel 11 is in engagement with the cannon-pinion CH. Furthermore, the first wheel 12 constitutes a second input of the notched wheel. The first wheel comprises a pinion 12 in engagement with the hour wheel RH. The wheel 11 and the pinion 12 are advantageously pivoted in a coaxial manner. A wheel 13 is integral with the wheel 11 and meshes with the wheel 9. The first and second inputs of the notched wheel MC possess the feature of being capable of disengagement by means of a spring R3 mounted on the wheel 13, which is provided in order to interact with a cam 14 that is integral with the pinion 12 or fixed to the pinion 12.

During the conventional operation of the timepiece, the elements 11, 13 and 12 are joined together by means of the elements 14 and R3 in such a way, on the one hand, as to constitute a motion-work wheel disposed at the interface of the cannon-pinion CH and the hour wheel RH, and, on the other hand, as to permit the activation of the first kinematic chain C1, namely the driving of the second element PDL for the display of the second watch information derived from time by the hour wheel RH by means of the epicyclic gear train TE.

The notched wheel MC is likewise an integral part of the kinematic correction chains CC1 and CC2.

The notched wheel MC is included in the first kinematic correction chain CC1. More particularly, the notched wheel MC is connected to the stem T by means of its first input 11. Thus, when the first kinematic correction chain CC1 is activated by means of the switching mechanism COM, as depicted in FIG. 9, a rotation of the stem T permits the adjustment of the hour, of the minutes, of the date and of the phase of the moon, the elements 11, 13 and 12 of the notched wheel being joined together by means of the elements 14 and R3.

The notched wheel MC is also included in the second kinematic correction chain CC2. More particularly, the notched wheel MC is connected to the stem T by means of its second input 12. Thus, when the second kinematic correction chain CC2 is activated by means of the switching mechanism COM, as depicted in FIG. 10, a rotation of the stem T permits the adjustment of the hour, or of the date, independently of the minutes and the display of the phase of the moon according to a predetermined angular pitch, more particularly predetermined by the elements 14 and R3, the elements 11, 13 being maintained in position by the cannon-pinion CH which is mounted frictionally on the going train of the basic movement. The friction torque of the cannon-pinion on the going train of the basic movement, when brought back to the level of the axis of the notched wheel, is greater than the resistive torque created around the axis of the notched wheel by the elements 14 and R3. Thus, when the first wheel 12 is acted upon via the stem, the second wheel 11, 13 remains immobile on account of the friction torque of the cannon-pinion on the going train of the basic movement. It follows that the spring R3 is deformed by action of the cam 14 and the first wheel is displaced by one step in relation to the second wheel. The amplitude of the step, in this case 90°, is defined by the geometry of the cam 14. The second kinematic correction chain CC2 thus permits the rapid adjustment of the element for the display of the hours, and in particular the rapid adjustment of the element for the display of the date, which is in engagement with the hour wheel RH, via the wheel 10 and a wheel MQ.

The notched wheel MC is thus disposed within the kinematic correction chains CC1 and CC2 in such a way, on the hand, as to permit the simultaneous adjustment of the hour and the minutes, of the first watch indication or an indication derived from time, and of any additional watch indication or an indication derived from time, and, on the other hand, to permit the independent adjustment of the hour, or of the date, and of any additional watch indication or an indication derived from time, according to an angular pitch determined by the notched wheel MC.

The expression "wheel", is intended to denote any watch assembly comprising at least a toothed wheel and/or a toothed pinion.

The expression "notched wheel", is intended to denote preferably an assembly comprising a first wheel and a second wheel, the first wheel being displaceable relative to the second wheel, and the first and second wheels being connected by an indexing element of the first wheel relative to the second wheel. The first and second wheels are preferably coaxial. The indexing element preferably comprises a cam and a spring.

The expression "basic movement" is intended to denote any watch movement equipped with at least one going train permitting the counting of time, more particularly the counting of the minutes.

The word "second" in the expression "second wheel" is a numeral adjective used for distinguishing a wheel among several wheels. Thus, a "second wheel" is not necessary a wheel that rotates at a speed of a revolution per minute.

The invention claimed is:

1. A watch mechanism comprising an element for display of time, a first element for display of a first piece of watch information derived from time and a second element for display of a second piece of watch information derived from time, the mechanism comprising:

a first kinematic chain for simultaneous correction of the display of time, the display of the first piece of watch information and the display of the second piece of watch information, a second kinematic chain for correction of the display of time independently of the display of the second piece of watch information, and a third kinematic chain for correction of the display of the second piece of watch information independently of the display of time and the display of the first piece of watch information, the third kinematic correction chain comprising an epicyclic gear train, the epicyclic gear train being connected kinematically to the element for the display of time by a notched wheel, and the first and second kinematic chains comprising the notched wheel.

2. The watch mechanism as claimed in claim 1, wherein the notched wheel is a motion-work wheel.

3. The watch mechanism as claimed in claim 1, wherein the notched wheel comprises a first wheel engaged with an hour wheel and a second wheel engaged with a cannon-pinion, the first and second wheels being connected by an indexing element of the first wheel relative to the second wheel.

4. The watch mechanism as claimed in claim 3, wherein the indexing element comprises a spring mounted on the second wheel and a cam mounted on the first wheel, the spring and the cam being arranged so as to interact through contact one with the other.

5. The watch mechanism as claimed in claim 1, wherein the epicyclic gear train comprises a planetary gear carrier in permanent kinematic connection with the notched wheel, a first planetary pinion in permanent kinematic connection with an element for the correction of the second piece of watch information, a second planetary pinion in permanent kinematic connection with a wheel of the second element for the display of the second piece of watch information and at least one planetary gear pivoted on the planetary gear carrier.

6. The watch mechanism as claimed in claim 5, wherein the first and second planetary pinions are in meshing engagement with the at least one planetary gear via external teeth of the first and second planetary pinions.

7. The watch mechanism as claimed in claim 5, wherein the planetary gear carrier comprises external toothing.

8. The watch mechanism as claimed in claim 5, wherein a pitch circle radius of the second planetary pinion is smaller than the axial distance of the gearing constituted by the first planetary pinion and the at least one planetary gear, or the pitch circle radius of the second planetary pinion is substantially equal to the pitch circle radius of the first planetary pinion, or the pitch circle radius of the second planetary pinion is smaller than the pitch circle radius of the first planetary pinion.

9. The watch mechanism as claimed in claim 5, wherein the correction element is a correction wheel comprising a correction star arranged so as to be actuated by a means of control.

10. The watch mechanism as claimed in claim 1, wherein the first and second kinematic correction chains are arranged so as to be capable of being engaged with a stem.

11. The watch mechanism as claimed in claim 1, wherein the first piece of watch information derived from time is a piece of calendar information.

12. The watch mechanism as claimed in claim 1, wherein the second piece of watch information derived from time is a piece of moon phase information.

13. A watch movement comprising a mechanism as claimed in claim 1.

14. A timepiece comprising a watch movement as claimed in claim 13.

15. A timepiece comprising a mechanism as claimed in claim 1.

16. The watch mechanism as claimed in claim 4, wherein the cam is on the first wheel.

17. The watch mechanism as claimed in claim 9, wherein the means of control is a lever.

18. The watch mechanism as claimed in claim 11, wherein the first piece of watch information derived from time is a piece of date information.

19. The watch mechanism as claimed in claim 2, wherein the notched wheel comprises a first wheel engaged with an hour wheel and a second wheel engaged with a cannon-pinion, the first and second wheels being connected by an indexing element of the first wheel relative to the second wheel.

20. The watch mechanism as claimed in claim 19, wherein the indexing element comprises a spring mounted on the second wheel and a cam mounted on the first wheel, the spring and the cam being arranged so as to interact through contact one with the other.

* * * * *